US005588478A

United States Patent [19]

Jin et al.

[11] Patent Number: 5,588,478

[45] Date of Patent: Dec. 31, 1996

[54] CONTROL OF STICKING IN TWIN ROLL CASTING

[75] Inventors: Iljoon Jin; David J. Lloyd; Roland S. Timsit, all of Kingston; Eric R. Lees, Harrowsmith, all of Canada

[73] Assignee: Alcan International Limited, Montreal, Canada

[21] Appl. No.: 182,683

[22] Filed: Jan. 18, 1994

Related U.S. Application Data

[63] Continuation of Ser. No. 986,244, Dec. 7, 1992, abandoned.

[30] Foreign Application Priority Data

Apr. 28, 1992 [CA] Canada ..... 2067438

[51] Int. Cl.[6] ..... B22D 11/06

[52] U.S. Cl. ..... 164/480; 164/479; 164/463; 164/473

[58] Field of Search ..... 164/427, 428, 164/459, 463, 472, 473, 477, 479, 480

[56] References Cited

U.S. PATENT DOCUMENTS

| | | | |
|---|---|---|---|
| 3,830,635 | 8/1974 | Chia et al. | 164/463 |
| 4,093,475 | 6/1978 | Manzonelli et al. . | |
| 4,751,958 | 6/1988 | Flowers et al. | 164/473 |
| 4,865,117 | 9/1989 | Bartlett et al. | 164/479 |
| 5,053,286 | 10/1991 | Pratt et al. | 164/480 |
| 5,103,895 | 4/1992 | Furuya et al. | 164/480 |

FOREIGN PATENT DOCUMENTS

| | | | |
|---|---|---|---|
| 654739 | 2/1965 | Belgium . | |
| 523643 | 1/1993 | European Pat. Off. . | |
| 0058963 | 4/1983 | Japan | 164/480 |
| 0133153 | 5/1990 | Japan | 164/480 |
| WO92/21456 | 12/1992 | WIPO . | |

OTHER PUBLICATIONS

Patent Abstract of Japan—vol. 14, No. 323 (M–997) Jul. 11, 1990 JP A,21 08 441 (NKK Corp) Apr. 20, 1990.

Patent Abstract of Japan—vol. 3, No. 7 (C–034) Jan. 24, 1979 JP A, 53 132 419 (Sumitomo Electric Inc. Ltd) Nov. 18, 1978.

Patent Abstract of Japan—vol. 6, No. 236 (M–173) (1114) Nov. 25, 1992 JP A, 57 134 249 (Matsushita Denki Sangyo KK) Aug. 19, 1982.

Patent Abstract of Japan—vol. 13, No. 591 (M–913) (3939) Dec. 26, 1989 JP A, 12 49 244 (Nippon Yakin Kogyo Co. Ltd) Oct. 4, 1989.

Patent Abstract of Japan—vol. 13, No. 500 (M–891) Nov. 10, 1989 JP A, 12 02 345 (Kobe Steel Ltd) Aug. 15, 1989.

*Primary Examiner*—Kurt Rowan

*Attorney, Agent, or Firm*—Cooper & Dunham LLP

[57] ABSTRACT

A high speed twin roll casting process is described in which molten metal is fed through a feeding nose into a convergent cavity formed between the walls of two rotating rolls with a meniscus of hot metal extending from the feeding nose tip in a casting zone and the metal strip formed in the casting zone is reduced in a rolling zone. According to the novel feature, the tendency of the metal strip to stick to the rolls is significantly inhibited by shrouding the hot metal meniscus with an oxygen enriched atmosphere. Also when the metal is an Al—Mg alloy, the sticking is greatly inhibited by adding to the alloy a small amount of at least one alloying element selected from nickel, lead, indium and bismuth.

5 Claims, 1 Drawing Sheet

CONTROL OF STICKING IN TWIN ROLL CASTING

This is a continuation of application Ser. No. 986,244 filed Dec. 7, 1992 now abandoned.

BACKGROUND OF THE INVENTION

This invention relates to control of sticking in high speed twin roll casting, particularly in the casting of aluminum alloys.

In twin roll casting, hot metal is fed through a feeding nose into a convergent cavity formed between the walls of two rotating rolls. Heat is extracted from the melt into the roll shells which are water cooled from the inside. Solidification is completed within a distance between the nose tip and the roll nip (the casting zone) and the solid metal is rolled over an arc of a given length (the rolling zone). The length of the rolling zone depends on the type of caster and operating conditions. In the rolling zone, the strip is reduced up to 50% depending on the length of the rolling zone and the roll diameter.

High speed twin roll casting offers a high productivity and the potential of producing high performance sheet products for the future aluminum market. In this process, the length of the rolling zone is relatively short. A problem associated with this process, which occurs in the absence of any applied parting layer, is strip sticking to the rolls for most commercial aluminum alloys. When sticking occurs, the strip adheres to either or both of the rolls somewhere along the arc of contact. The only aluminum alloys that can be cast without the sticking problem are Al—Mg alloys that have Mg concentrations of about 2% by weight or higher.

A usual cure for the sticking condition is to apply a parting layer, such as graphite powder, to the roll surface. However, such parting layer application requires a delicate control of the process, and reduces the high solidification rate, which is one of the inherent advantages of the process.

U.K. Patent Application GB 2,119,294, published Nov. 16, 1983 describes a method of making sheets of aluminum suitable for ironing in which "galling" problems during processing are solved by treatment in an oxidizing atmosphere. In this process, the oxidizing atmosphere is used in the heat treatment applied to the solidified product of the rolling operation.

It is the object of the present invention to provide a simple method of preventing sticking while maintaining the high speed of a high speed twin roll casting operation.

SUMMARY OF THE INVENTION

According to one embodiment of the present invention, it has been discovered that the sticking problem can be overcome by oxygen enrichment of the atmosphere around the molten aluminum entering a twin roll casting system. The conventional wisdom in twin roll casting suggests that such a process would result in unacceptable oxidation of the melt with associated dross formation. Very surprisingly, this does not appear to happen.

Thus, in accordance with one process embodiment of the present invention, molten metal is fed through a feeding nose into the convergent cavity formed between the walls of two rotating rolls with a molten metal meniscus forming adjacent to the nose tip. During the process, the molten metal meniscus is shrouded by means of a highly oxidizing gas. It has been found that this method allows high speed casting of aluminum alloys which contain less than 2% by weight of magnesium.

It has been found that in high speed twin roll casting, the molten metal which is introduced into the roll bite oxidizes at the meniscus under normal air atmosphere (21% $O_2$). It is believed that the nature of the oxide formed plays a significant role on the contact interface between the roll surface and the material in the roll bite, and hence on the sticking. It has particularly been found that an oxygen enriched atmosphere significantly changes the nature of the oxide, and hence the sticking. Such atmosphere preferably contains at least 25% oxygen.

According to a further embodiment, it has been found that the addition of small amounts of certain alloying elements to the molten metal being cast helps to inhibit sticking. This is effective even without the presence of an oxygen enriched atmosphere. Elements that have been found to be particularly effective are selected from one or more of nickel, lead, bismuth and indium. The lead, bismuth and indium have been found to be effective in amounts of less than 0.15% by weight, while the nickel is used in amounts up to 1% by weight. These added elements are preferably used in amounts of: Ni(0.1–1.0 wt %), Pb (0.005–0.15 wt %), Bi (0,005–0.15 wt %) and In (0,005–0.15 wt %).

The sticking behaviour is also affected by certain casting parameters, particularly the metal head level in the tundish, the casting speed and an object which disturbs the roll surface, e.g. a brush or the casting tip itself. For instance, an alloy which according to the invention does not normally stick with an oxygen enriched atmosphere may sometimes show unexpected sticking when the metal head level is allowed to remain too low, or if the casting speed is either too low or too fast, or when the roll surface was rubbed extensively. These minor problems may easily be avoided by, for example, keeping the metal head level higher than about 20 mm above the roll nip, casting at a speed in the range of 2.5–15 m/min. when casting a 1–4 mm thick strip and avoiding any contact of stationary objects on the rolls.

BRIEF DESCRIPTION OF THE DRAWING

The attached drawing

Figure 1:
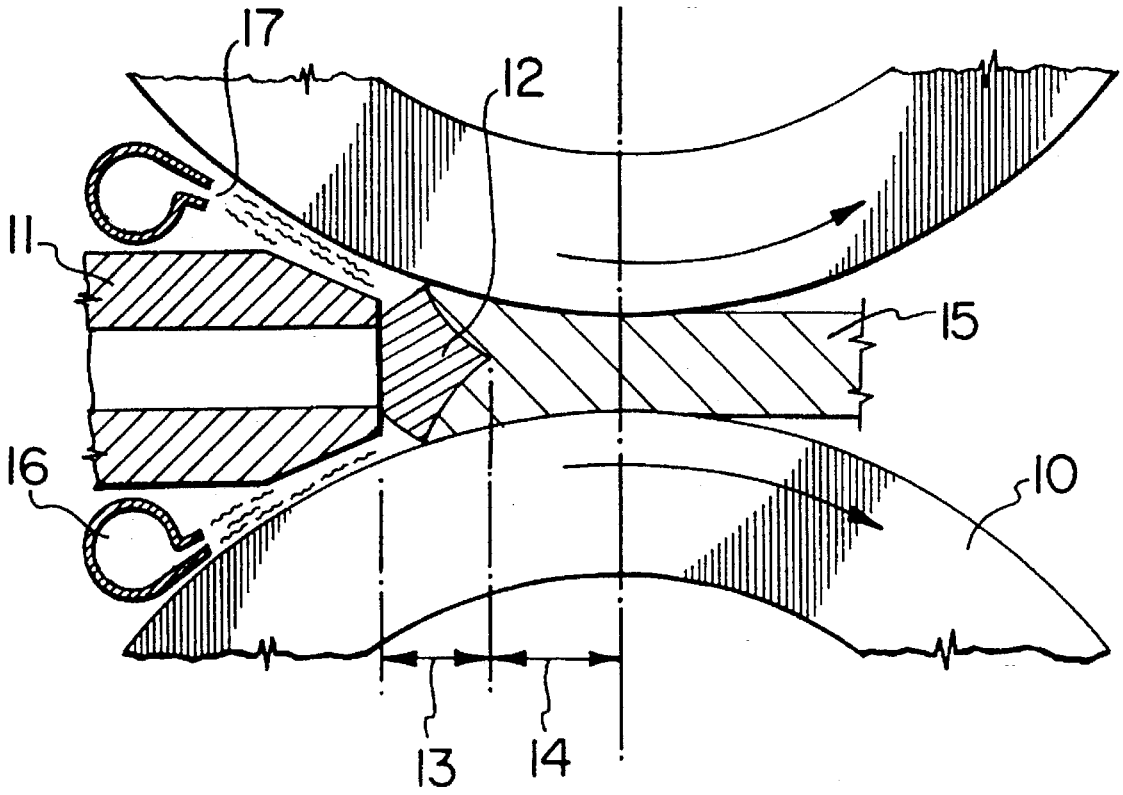
FIG. 1 is a schematic illustration of a roll cavity incorporating one embodiment of the invention.

As shown in the drawing, a pair of rolls 10 form a roll bite therebetween within which is located a feeding nose 11. Hot metal is fed from the feeding nose 11 into the roll bite with a meniscus of hot metal 12 extending from the feeding nose tip. This forms part of the casting zone 13. The mushy or solid metal and the rolls remain in contact through rolling zone 14 with the strip being reduced up to 50% depending on the length of the rolling zone and the roll diameter. The formed strip 15 then emerges from the rolls.

The oxygen enriched atmosphere is created in the region surrounding the hot metal meniscus 12 and this is done by flowing gas into the region. For this purpose a pair of elongated gas nozzles 16 are located above and below the feeding nose 11 and generally parallel to the axes of the rolls. Each nozzle 16 includes a gas ejection slit 17 having a length at least equal to the width of the metal strip being formed. The gas flows out from these slits and blankets the region surrounding the hot meniscus 12.

Other preferred features of the invention are illustrated by the following non-limiting examples.

EXAMPLE 1

An aluminum-1.5 wt % magnesium alloy was cast on a research twin roll caster of the type shown in FIG. 1 under high speed casting conditions using (1) pure nitrogen, (2) nitrogen-21% oxygen and (3) nitrogen-31% oxygen as shrouding gases. Initially the rolls were coated with graphite powder. the caster was operated with a tundish temperature of 700°–710° C., a casting speed of 5–5.5 m/min, a strip thickness of 2.5 mm, a strip width of 250 mm and a tip setback of 37±1mm. The shrouding gas was fed at a rate of 140l/min. When the pure nitrogen gas was used, strip sticking occurred from the start of the casting. When the nitrogen-21% oxygen gas (dry air) was used, the casting could be made while the initial graphite coating was present on the roll surface. With the nitrogen-31% oxygen gas shrouding, the casting was possible without sticking even after the initial coating was eliminated.

EXAMPLE 2

The same twin roll caster as described in Example 1 was used under generally the same conditions. The metal being cast was an aluminum-1.5 wt % magnesium alloy to which various alloying elements were added. The rolls were initially coated with graphite powder, with the caster operating with a tundish temperature of 700°–710° C., a casting speed of 5–5.5 m/min., a strip thickness of 2.5 mm, a strip width of 250 mm and a tip set back of 37±1 mm. The shrouding gas was nitrogen-30% oxygen and this is fed at a rate of 140 l/min.

The trial castings were carried out for the purpose of determining sticking and the results obtained are shown in Table I below:

TABLE I

| Gas Type | Additive wt % or ppm | Gas Flow Rate (l/min) | Remarks |
|---|---|---|---|
| $N_2$—30% $O_2$ | Ca (0.1%) | 140 | Increased Sticking |
| $N_2$—30% $O_2$ | Sr (0.1%) | 140 | Increased Sticking |
| $N_2$—30% $O_2$ | Si (0.3–7%) | 140 | Increased Sticking |
| $N_2$—30% $O_2$ | Na (20 ppm) | 140 | Increased Sticking |
| $N_2$—30% $O_2$ | P (100 ppm) | 140 | Increased Sticking |
| $N_2$—30% $O_2$ | Li (0.1%) | 140 | No affect |
| $N_2$—30% $O_2$ | Fe (0.1–0.5%) | 140 | No affect |
| $N_2$—30% $O_2$ | Cu (0.5%) | 140 | No affect |
| $N_2$—30% $O_2$ | Sn (0.1%) | 140 | No affect |
| $N_2$—30% $O_2$ | Sb (0.1%) | 140 | No affect |
| $N_2$—30% $O_2$ | Ti (0.001–0.1%) | 140 | No affect |
| $N_2$—30% $O_2$ | Ni (0.30–0.5%) | 140 | Sticking Eliminated |
| $N_2$—30% $O_2$ | Pb (0.1%) | 140 | Sticking Eliminated |
| $N_2$—30% $O_2$ | Bi (0.1%) | 140 | Sticking Eliminated |
| $N_2$—30% $O_2$ | In (0.12%) | 140 | Sticking Eliminated |

It will be noted that the first five elements used actually increased sticking while the next six additives showed no affect. On the other hand, the last four elements shown in Table I totally eliminated the sticking when used together with a Nitrogen-30% oxygen gas.

It is not understood why the last four elements listed in Table I are uniquely effective in their ability to affect sticking.

We claim:

1. In a high speed twin roll casting process for forming a metal strip in which molten aluminum alloy containing alloying amounts of magnesium is fed through a feeding nose into a convergent cavity formed between the walls of two rotating rolls with a meniscus of hot metal extending from the feeding nose tip in a casting zone and the metal strip formed in the casting zone is reduced in a rolling zone, the improvement which comprises shrouding the hot metal meniscus with an oxygen enriched atmosphere by feeding into the region of said meniscus a gas containing at least 25% oxygen to inhibit sticking of the metal strip to the rolls.

2. A process according to claim 1, wherein the aluminum alloy contains less than 2% by weight of magnesium.

3. A process according to claim 1, wherein the oxygen enriched gas is fed through elongated injection slits located above and below the feeding nose tip.

4. A process according to claim 3 wherein the slits are generally parallel to the axes of the rolls.

5. In a high speed twin roll casting process for forming a metal strip in which molten Al—Mg alloy containing less than 2 wt % Mg is fed through a feed nose into a convergent cavity formed between the walls of two rotating rolls with a meniscus of hot metal extending from the feeding nose tip in a casting zone and the metal strip formed in the casting zone is reduced in a rolling zone, the improvement which comprises shrouding the hot metal meniscus with an oxygen enriched atmosphere by feeding into the region of said meniscus a gas containing at least 25% oxygen to prevent sticking of the alloy strip to the rolls, and adding a small amount of at least one further alloying element to the Al—Mg alloy for inhibiting sticking, said further element being selected from the group consisting of nickel, lead, bismuth and indium.

* * * * *